US005514931A

United States Patent [19]

Dasgupta et al.

[11] Patent Number: 5,514,931

[45] Date of Patent: May 7, 1996

[54] APPARATUS FOR DISPLAYING VIDEO IMAGES

[75] Inventors: Basab B. Dasgupta; Mark A. Schmidt, both of Escondido, Calif.

[73] Assignees: Sony Corporation, Tokyo, Japan; Sony Electronics, Inc., Park Ridge, N.J.

[21] Appl. No.: 251,478

[22] Filed: May 31, 1994

[51] Int. Cl.[6] ..... H01J 29/70; H01F 7/00; H01F 3/12; H01F 1/00

[52] U.S. Cl. ..... 313/440; 335/210; 335/211; 335/212

[58] Field of Search ..... 313/440; 335/210, 335/211, 212; 315/339

[56] References Cited

U.S. PATENT DOCUMENTS 4,246,560 1/1981 Shimizu ..... 335/212
5,177,412 1/1993 Morohashi ..... 335/210

*Primary Examiner*—Sandra L. O'Shea
*Assistant Examiner*—John Ning
*Attorney, Agent, or Firm*—William S. Frommer; Alvin Sinderbrand

[57] ABSTRACT

An apparatus for displaying video images. A video image display apparatus including a cathode ray tube device for producing a plurality of electron beams each corresponding to a respective color and, in response to a magnetic field, for converging the electron beams onto a screen of the cathode ray tube device so as to cause video images corresponding to the converged electron beams to be displayed thereon. The apparatus further includes a deflection yoke device for producing the magnetic field. The deflection yoke device is arranged such that an inner surface thereof is adjacent to an outer surface of the cathode ray tube device. The inner surface of the deflection yoke device has a predetermined contour such that a distance between the outer surface of the cathode ray tube device and the inner surface of a middle portion of the deflection yoke device is substantially larger than each respective distance between the inner surface of both end portions of the deflection yoke device and respective adjacent parts of the outer surface of the cathode ray tube device.

19 Claims, 7 Drawing Sheets

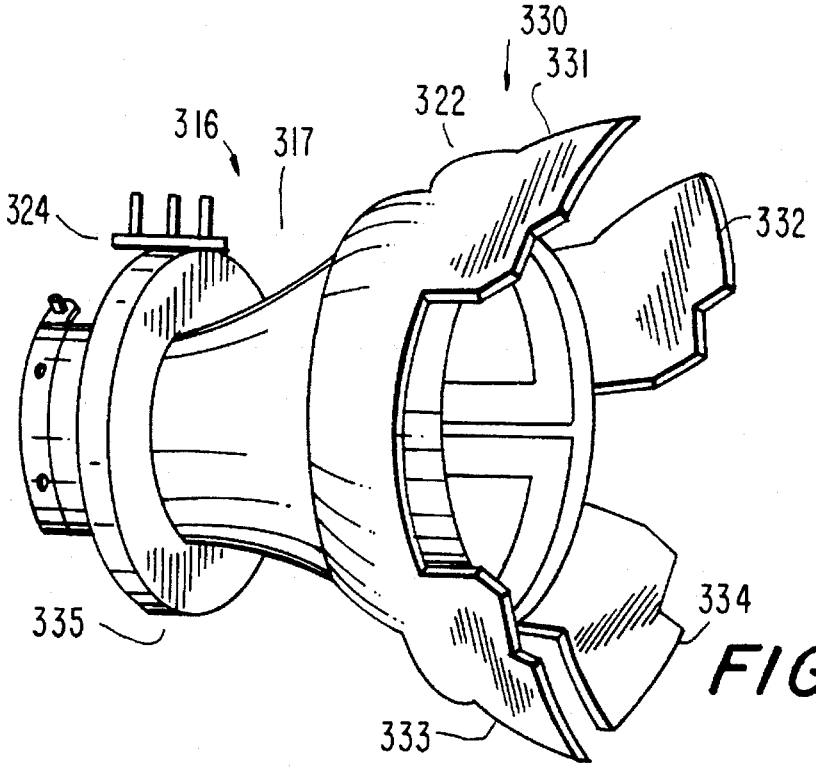
FIG. 10
FIG. 13
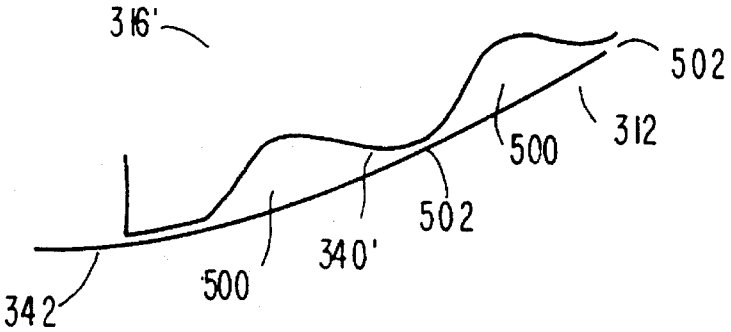

APPARATUS FOR DISPLAYING VIDEO IMAGES

BACKGROUND OF THE INVENTION

1. Field of the Invention

The present invention relates to an apparatus for displaying video images and, more particularly, to a cathode ray tube apparatus having a deflection yoke.

2. Description of the Prior Art

Typically, a cathode ray tube (CRT) apparatus produces electron beams which may be deflected electromagnetically so as to enable the electron beams to properly scan a designated area on a screen. An example of such CRT apparatus is illustrated in FIG. 1.

As shown in FIG. 1, a CRT apparatus 10 generally includes an envelope portion 12, an electron gun or guns 14, a deflection yoke (DY) 16, a shadow mask or aperture grill 20, and a screen or panel 18. The envelope portion 12, which may be fabricated from glass, ceramic or metal like material, includes a neck portion 13 wherein the electron gun(s) 14 are mounted. Each such electron gun 14 is adapted to produce a beam of electrons.

In a monochrome CRT apparatus, there is normally one electron gun, whereas in a color CRT apparatus there are normally three electron guns. In the following discussion, the CRT apparatus 10 will be described as a color CRT apparatus, although such CRT apparatus may be a monochrome type CRT apparatus.

The DY 16 may include a plurality of sections or pairs of shaped coil members, such as two shaped coil members **16*a* and 16*b*. The DY 16 may further include a vertical coil 16*c* which may be wound around a ferrite core and a horizontal coil 16*d*. The members 16*a* and 16*b* are arranged around the neck portion 13 in a predetermined manner. Such arrangement results in gaps or spaces between various positions on an inner surface 72 of the DY 16 and corresponding positions on an outer surface 70 of the envelope 12. More specifically, a gap 80 may exist between the inner surface 72 of a rear portion 24 of the DY 16 and a corresponding portion 50 of the outer surface 70, a gap 82 may exist between the inner surface 72 of a middle portion 23 of the DY 16 and a corresponding portion 52 of the outer surface 70, and a gap 84 may exist between the inner surface 72 of a front portion 22 of the DY 16 and a corresponding portion 54 of the outer surface 70**.

The DY 16 and, in particular, the inner surface 72 thereof, is fabricated and arranged on the envelope 12 such that the values of the gaps 80, 82 and 84 increase from the rear portion to the front portion. That is, the value of the gap 80 has the smallest value, the value of the gap 84 has the largest value, and that of the gap 82 has a value between that of gaps 80 and 84. Further, gap 80 has a relatively small value and may have a value of zero, whereupon the inner surface 72 of the rear portion 24 of the DY 16 contacts the portion 50 of the outer surface 70. Furthermore, the other gaps 82 and 84 have relatively small values. The values of gaps 82 and 84 typically enable the DY 16 to be tilted by approximately 2° around gap 80 (or the portion relating thereto) which effectively functions as a pivot point. The gap 84 may be utilized for tilt adjustment so as to compensate for misalignment which may be due to tolerance errors or the like.

The DY 16, in response to a signal, such as a pulsating current signal, is adapted to produce an electromagnetic field having predetermined characteristics or shape. As a result of such electromagnetic field, the three beams from the three electron guns 14, which respectively correspond to different colors, such as red, green and blue (RGB), are deflected in a predetermined manner.

The screen 18 may have a spherical shape. The shadow mask or aperture grill 20 is located relatively close to the screen 18. Such shadow mask or aperture grill may include a plurality of relatively small apertures, which may have a round or elongated slit shape, each respectively associated with a group of red, green and blue light-emitting elements (not shown) of the screen 18. The shadow mask or aperture grill 20 is adapted to enable the electron beams from the three electron guns 14 to properly strike the appropriate light-emitting elements of the screen 18.

Therefore, electron beams produced by the electron guns 14 are deflected due to the electromagnetic field created by the DY 16 so as to pass through the aperture grill 20 and strike the appropriate light-emitting elements of the screen 18. As a result, a color image is displayed on the screen 18.

The video image provided on the screen 18 may be distorted by so-called left/right or East/West (EW) pin-cushion distortion of the geometric raster and other types of geometric and misconvergence distortions. Examples of a displayed video image having such distortion are illustrated in FIGS. **2*a* and 2*b*. That is, FIGS. 2*a* and 2*b* illustrate a video image displayed on the screen 18** having an EW pin-cushion shaped distortion of a rectangular raster and an EW barrel shaped distortion, respectively.

In an attempt to correct for EW pin-cushion distortion, the magnetic field created by the vertical deflection coil **16*c* of the DY 16 may be shaped so as to have a pin-cushion shape at the front portion 22 of the DY 16 and a barrel shape at the rear portion 24 of the DY 16. An example of such vertical magnetic field having pin-cushion shaped field or flux lines 46 and barrel shaped field or flux lines 48 are illustrated in FIGS. 3 and 4, respectively. A deflection yoke 116, as illustrated in FIG. 5**, may be utilized in an attempt to obtain such magnetic field. Such distortion and magnetic fields are described in an article entitled "Designing Self-Converging CRT Deflection Yokes", by Basab B Dasgupta, Information Display, 1/92, pp 15–19, which is hereby incorporated by reference.

As shown in FIG. 5, a member such as a so-called mold core device 135 is coupled to a rear portion 124 of the DY 116. The mold core device 135 is typically formed from a magnetic material having relatively high permeability by use of a molding process. Such mold core device produces a magnetic field having barrel-shaped field lines.

As further shown in FIG. 5, a member 130 known as a cross-arm (i.e., cold rolled silicon steel arm) is coupled to a front portion 122 of the DY 116. Such cross-arm member 130, as shown in FIG. 6, includes a plurality of members, such as four members 131–134, which have respective effective magnetic poles associated therewith and which are arranged in a predetermined manner. For example, members 131 and 133 may each be a north (N) magnetic pole, and members 132 and 134 may each be a south (S) magnetic pole. As a result of such arrangement, the cross-arm 130 is adapted to reshape the vertical magnetic field so as to have field lines 136 having a pin-cushion shape.

Alternatively, a pin-cushion shaped vertical coil field at the front and a barrel shaped field at the rear may be obtained by utilizing a biased winding in which the angular width of the coil is relatively narrow at the front and relatively wide at the rear. Examples of unbiased and biased coils are illustrated in FIGS. 12A–12D. That is, FIG. 12A illustrates an unbiased coil, FIG. 12B illustrates a severely biased coil, FIG. 12C illustrates a slightly biased coil, and FIG. 12D illustrates an unbiased coil.

Although the above-described DY 116 may provide a magnetic field with field lines having a barrel shape at the rear portion 124 and a pin-cushion shape at the front portion 122, such configuration may not always cause a video image to be displayed on a screen of a CRT apparatus in which distortion such as EW pin-cushion distortion of the geometric raster and other geometric and misconvergence distortions are eliminated or reduced to an acceptable level. As an example, consider a CRT apparatus having a panel with a cylindrical shape and which is relatively flat, such as model no. SD169-20V 100° CRT manufactured by the Sony Corporation a diagram of which is illustrated in FIG. 7.

As shown in FIG. 7, a CRT apparatus 200 generally includes an envelope 212, an electron gun 214, a deflection yoke (DY) 216, an aperture grill 220, and a screen or panel 218.

The envelope 212, which may be fabricated from glass, has a funnel portion 213. Such funnel portion may be a 100° funnel. The electron gun 214, which may be a Trinitron electron gun, is arranged within the funnel portion 213. The DY 216, having coil members **216*a* and 216*b*, having a vertical coil 216*c* which may be wound around a ferrite core and a horizontal coil 216*d*, is arranged around the funnel portion 213 as shown in FIG. 7 and is adapted to produce an electromagnetic field so as to deflect the electron beams from the electron gun 214 in a predetermined manner. Further, as shown in FIG. 7, the DY 216 is arranged or coupled to the envelope 212 so as to have the gaps or spaces 80, 82 and 84 between an inner surface 90 of the DY 216 and an outer surface 92 of the envelope 212 from a rear portion 224 to a front portion 22 in a manner similar to that previously described with reference to the DY 16 of FIG. 1**.

The screen 218 and aperture grill 220 function in a manner similar to that of the screen 18 and aperture grill 20 of the CRT apparatus 10 of FIG. 1 and, as such, will not be further described herein. However, unlike the screen 18, the screen 218 has substantially a cylindrical shape, such as that shown in FIG. 8. Furthermore, the panel 218 has a relatively flat surface, that is, the radius R of the panel 218 has a relatively large value. For example, the radius R of the panel 218 may have a value of approximately 1.5 to 2.0 times that of similar size panels of similar type CRT apparatuses, such as a 20V CRT manufactured by either the RCA Corporation or the Zenith Corporation. Such cylindrical and relatively flat shape of the panel 218 may provide a more acceptable viewing surface to an observer as compared to other less flat and spherical shape panels, such as that of CRT apparatus 10.

Even if the deflection yoke 216 is configured in a manner similar to that of the deflection yoke 116 of FIG. 5, the CRT apparatus 200 may not provide a video image on the screen 218 which is either free of distortions, such as EW pin-cushion distortion of the geometric raster and other geometric and misconvergence distortions, or in which such distortions are reduced to an acceptable level. The difficulty in obtaining such distortion free (or reduced distortion) video image is due, at least in part, to the cylindrical and relatively flat shape of the panel 218.

Thus, although the cylindrical and relatively flat shape of the panel 218 may provide a more acceptable viewing surface to an observer as compared to other less flat and spherical shape panels, such cylindrical and relatively flat shaped panel 218 may increase or aggravate the distortion of the displayed video image.

Therefore, the prior art has failed to provide a CRT apparatus, such as a CRT apparatus having a cylindrical and relatively flat panel, having a deflection yoke which produces a magnetic field such that a video image may be displayed on a screen of the apparatus without EW pin-cushion distortion of the geometric raster and other geometric and misconvergence distortions or with a minimum or relatively low amount of such distortion.

OBJECTS AND SUMMARY OF THE INVENTION

An object of the present invention is to provide an apparatus for displaying video images which overcomes the problems associated with the prior art.

More specifically, it is an object of the present invention to provide an apparatus for displaying video images having a deflection yoke having an inner surface with a predetermined contour which provides a predetermined spacing arrangement between the inner surface of the deflection yoke and an outer surface of a tube device of the apparatus for producing a magnetic field to deflect electron beams so as to cause a video image corresponding thereto to be displayed on a screen without EW pin-cushion distortion of the geometric raster and other geometric and misconvergence distortions or with a minimum or relatively low amount of such distortion.

Another object of the present invention is to provide an apparatus for displaying video images as aforesaid in which the deflection yoke includes a middle and two end portions and is couple to the tube device of the apparatus such that a distance between an inner surface of the middle portion and an adjacent part of an outer surface of the tube device is substantially larger than each respective distance between the inner surface of both end portions of the deflection yoke and respective adjacent parts of the outer surface of the tube device.

It is still another object of the present invention to provide an apparatus for displaying video images as aforesaid in which a rear one of the end portions of the deflection yoke includes a device for producing a magnetic field having a plurality of barrel shaped field lines associated therewith and in which a front one of the end portions of the deflection yoke includes a device for shaping the barrel shaped field lines of the magnetic field so as to have a pin-cushion shape.

Yet another object of the present invention is to provide an apparatus for displaying video images as aforesaid in which the distances between the inner surfaces of the end portions of the deflection yoke and the respective adjacent parts of the outer surface of the tube device are relatively small.

In accordance with an aspect of the present invention, an apparatus for displaying video images is provided. The apparatus comprises a cathode ray tube device having a screen for producing a plurality of electron beams each corresponding to a respective color and, in response to a magnetic field, for converging the electron beams onto the screen so as to cause video images corresponding to the converged electron beams to be displayed thereon. The apparatus further comprises a deflection yoke device for producing the magnetic field. The deflection yoke device is arranged such that an inner surface thereof is adjacent to an outer surface of the cathode ray tube device. The inner surface of the deflection yoke device has a predetermined contour such that a distance between the outer surface of the cathode ray tube device and the inner surface of a middle portion of the deflection yoke device is substantially larger than each respective distance between the inner surface of both end portions of the deflection yoke device and respective adjacent parts of the outer surface of the cathode ray tube device.

Other objects, features and advantages according to the present invention will become apparent from the following detailed description of an illustrated embodiment when read in conjunction with the accompanying drawings in which corresponding components are identified by the same reference numerals.

BRIEF DESCRIPTION OF THE DRAWINGS

FIG. 10 is a perspective view of a deflection yoke of the apparatus of FIG. 9;

FIG. 13 is a schematic diagram of a modification to the deflection yoke of the apparatus of FIG. 9.

DETAILED DESCRIPTION OF THE PREFERRED EMBODIMENT

Figure 9:
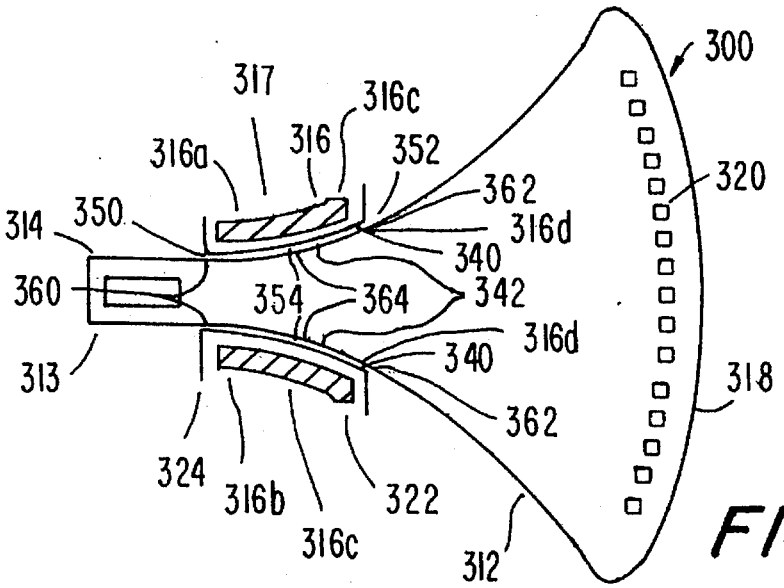
FIG. 9 is a schematic diagram of an apparatus for displaying video images according to an embodiment of the present invention.

FIG. 9 illustrates a CRT apparatus 300 for displaying a video image according to an embodiment of the present invention. As shown therein, the CRT apparatus 300 generally includes an envelope or tube portion 312, an electron gun 314, a deflection yoke (DY) 316, an aperture grill 320, and a screen 318.

Figure 1:
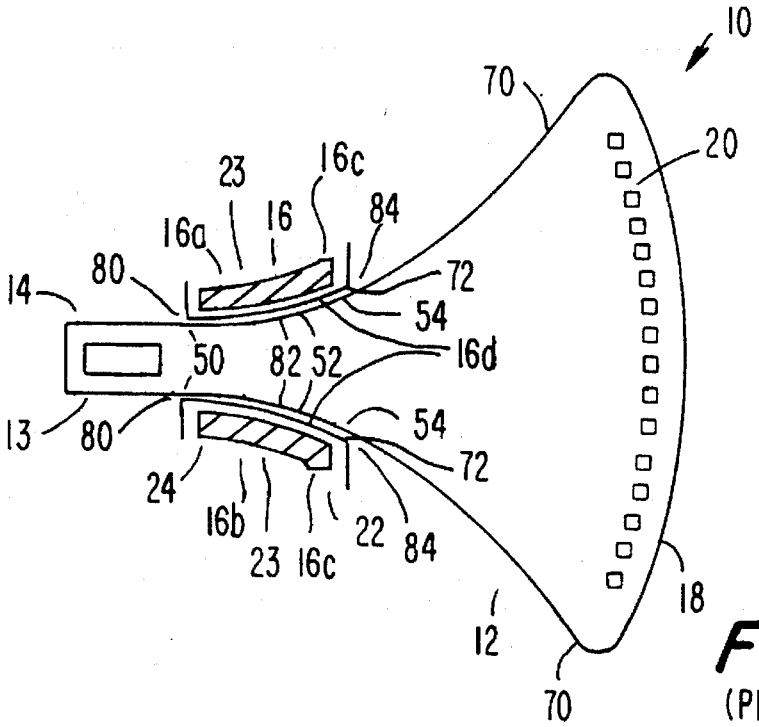
FIG. 1 (PRIOR ART)
FIG. 1 is a schematic diagram of an apparatus for displaying video images according to the prior art.
Figure 7:
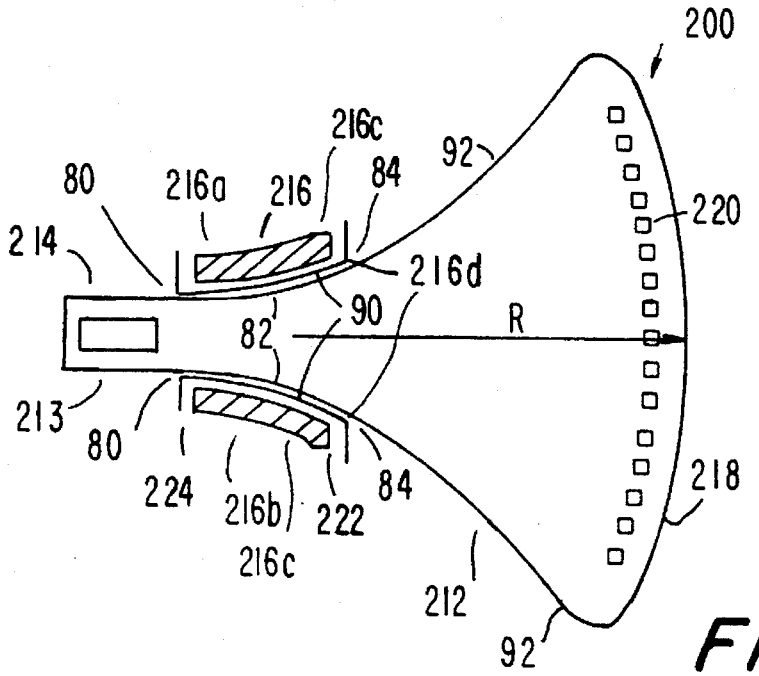
FIG. 7 (PRIOR ART)
FIG. 7 is a schematic diagram of another apparatus for displaying video images according to the prior art.
Figure 2A:
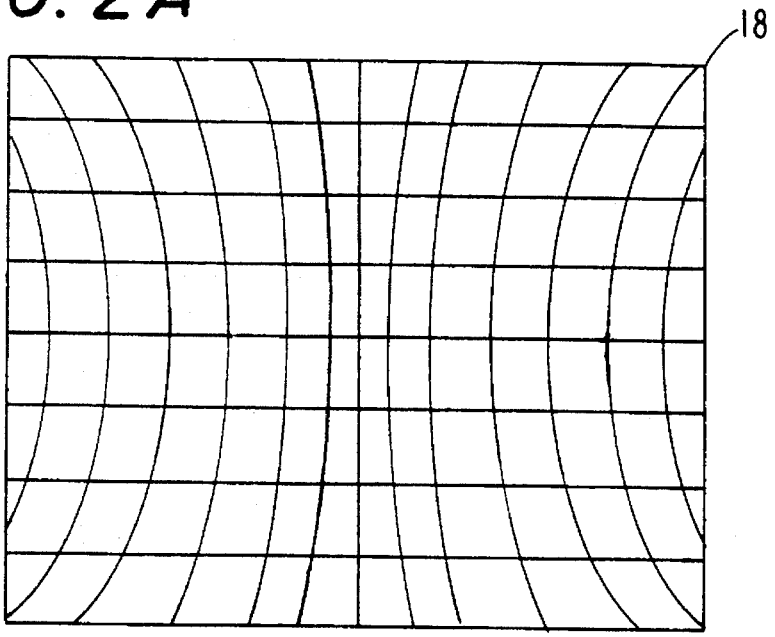
FIGS. 2A and 2B are diagrams of video images of a rectangular raster (grid) having EW pin-cushion shaped distortion and EW barrel shaped distortion, respectively.
Figure 2B:
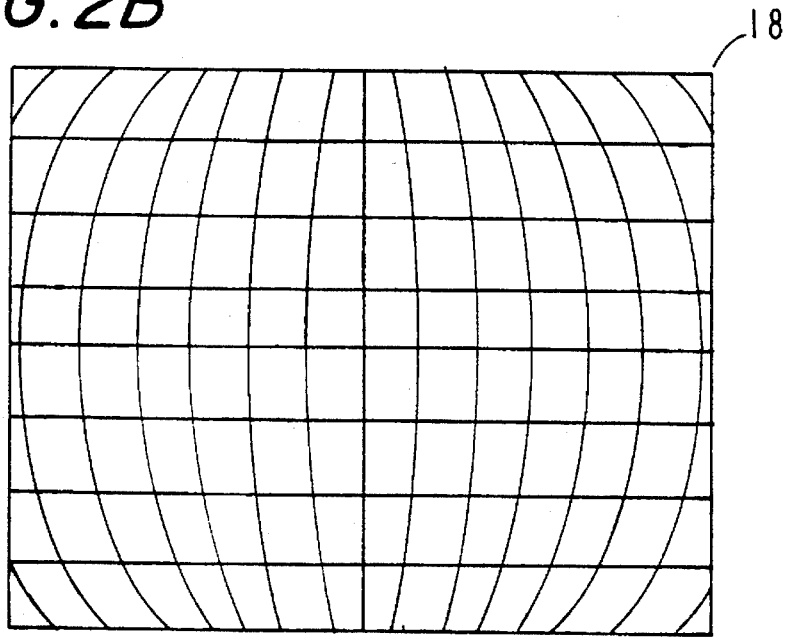
Figure 3:
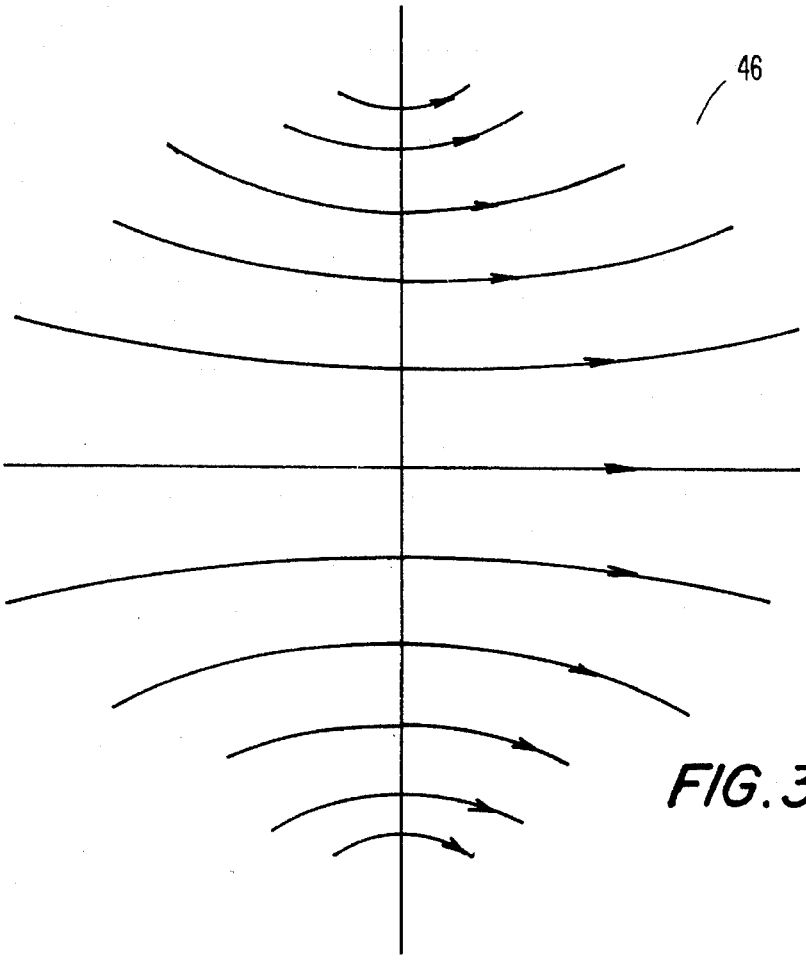
FIG. 3 is a diagram of pin-cushion shaped magnetic field lines for vertical deflection.
Figure 4:
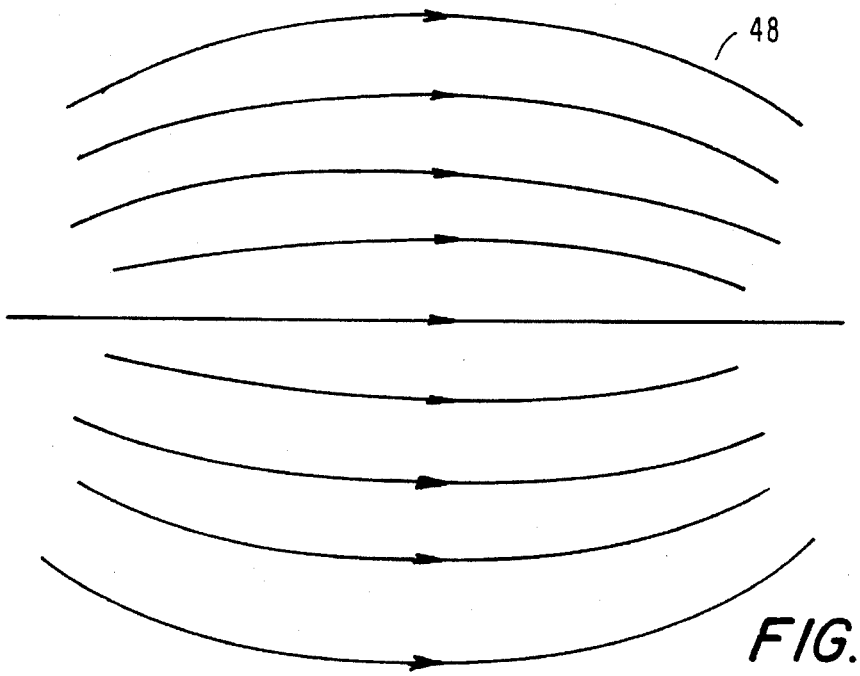
FIG. 4 is a diagram of barrel shaped magnetic field lines for vertical deflection.

The envelope or tube portion 312, the electron gun 314 and the screen 318 may be configured and arranged in a manner substantially similar to that of the CRT apparatuses 10 and 200 of FIGS. 1 and 7, respectively. Accordingly, only a brief description of these elements, including any differences therebetween, will be presented herein.

The envelope or tube portion 312 may be fabricated from glass or alternatively from a ceramic material, a metal-like material, or similar such materials. The envelope 312 includes a neck or funnel portion 313, which may be a 90° COTY (Combined Optimum Tube and Yoke) funnel, wherein the electron gun 314 may be arranged in a manner similar to that in the CRT apparatus 200 of FIG. 7. (Such COTY funnel refers to an industry standard COTY funnel.) Such electron gun 314 may be a COTY or Trinitron electron gun. The screen 318 may have a substantially cylindrical shape and a relatively flat surface in a manner similar to that of the screen 218 of the CRT apparatus 200 of FIG. 7. As an example, a COTY funnel Model No. SD 268 manufactured by Techneglas Corp. may be utilized with a SD 268 panel or screen manufactured by the Techneglas Corp.

Figure 5:
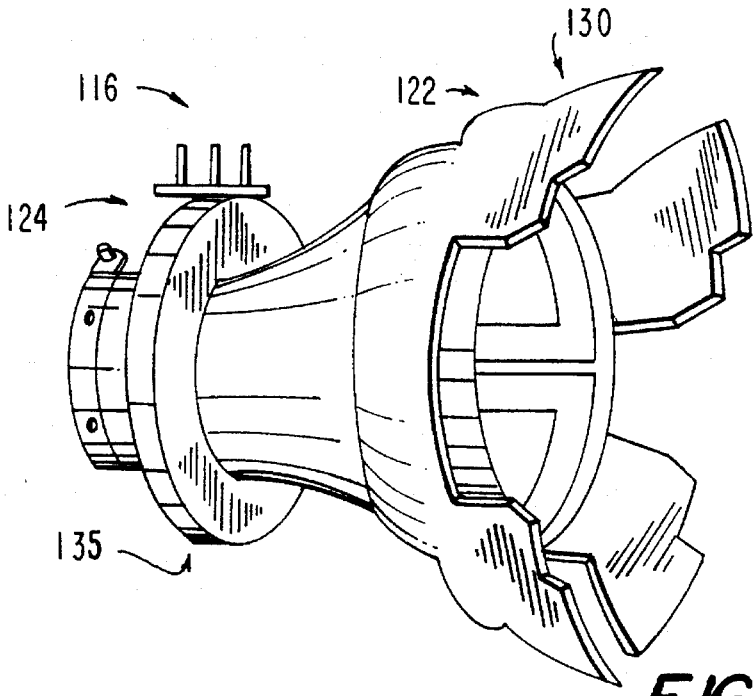
FIG. 5 is a perspective view of a deflection yoke.
Figure 6:
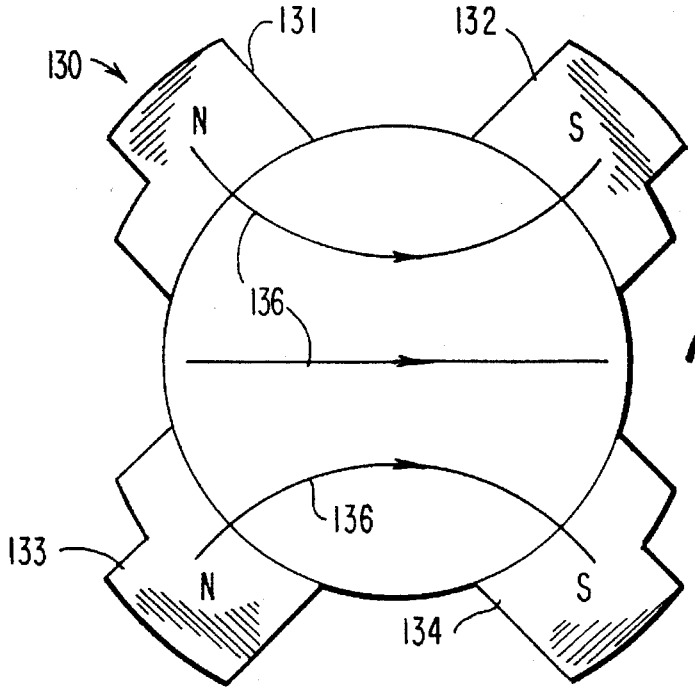
FIG. 6 is a schematic diagram of a portion of the deflection yoke of FIG. 5.
Figure 8:
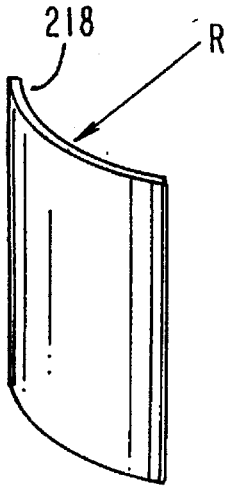
FIG. 8 is a perspective view of a panel of the apparatus of FIG. 7.

The DY 316 may have a plurality of sections or pairs of shaped coil members, such as two shaped coil members 316*a* and 316*b*, having a vertical coil 316*c* which may be wound around a ferrite coil and a horizontal coil 316*d*, which are arranged around the neck portion 313 in a predetermined manner. The DY 316 preferably includes a cross-arm 330 coupled to a front portion 322 of the DY 316 and a member such as a mold core device 335 coupled to a rear portion 324 of the DY as shown in FIG. 10. Such arrangement of the cross-arm and mold core device is substantially similar to that of the DY 116 of FIG. 5 and, as such, will not be further described herein. Further, the cross-arm 330 includes a plurality of members, such as four members 1331–334 which function in a substantially similar manner to that of the members 131–134 of the cross-arm 130.

The DY 316 has an inner surface 340 which has a predetermined contour which provides a predetermined spacing arrangement between such inner surface and an outer surface 342 of the envelope 312 when the DY is properly arranged or coupled in the CRT apparatus 300. More specifically, as shown in FIG. 9, the DY 316 and, in particular, the inner surface 340 thereof, is fabricated such that the portions of the inner surface 340 of the front and rear portions 322 and 324 thereof are relatively close to corresponding portions 362 and 360 of the outer surface 342, while the portion of the inner surface 340 of a middle portion 317 is relatively far removed from a corresponding portion 364 of the outer surface 342.

In other words, a gap or space 350 may exist between the inner surface 340 of the rear portion 324 of the DY 316 and the portion 360 of the outer surface 342, and a gap or space 352 may exist between the inner surface 340 of the front portion 322 and the portion 362 of the outer surface 342. Further, a gap or space 354 exists between the inner surface 340 of the middle portion 317 of the DY 316 and the portion 364 of the outer surface 342 of the envelope 312. The gap 354 is substantially larger than either of the gaps 350 and 352. The gaps 350 and 352 are preferably relatively small and may be zero, whereupon the respective one or ones of the inner surface 340 of the rear portion 324 and the front portion 322 may respectively contact the portions 360 and 362 of the outer surface 342. As a result of the values of the gaps 350 and 352, a snug fit may be provided between the DY 316 and the envelope 312. One of the gaps 350 and 352, preferably the front gap 352, may be utilized for tilt adjustment in a manner similar to that previously described with reference to the DY 16 of FIG. 1. Further, in a manner similar to that previously described with reference to the DY 16 of FIG. 1, the value of the gaps 350, 352 and 354 may enable the DY 316 to be tilted by approximately 2° around the gap 350 (or the portion relating thereto) which effectively functions as a pivot point.

Figure 11:
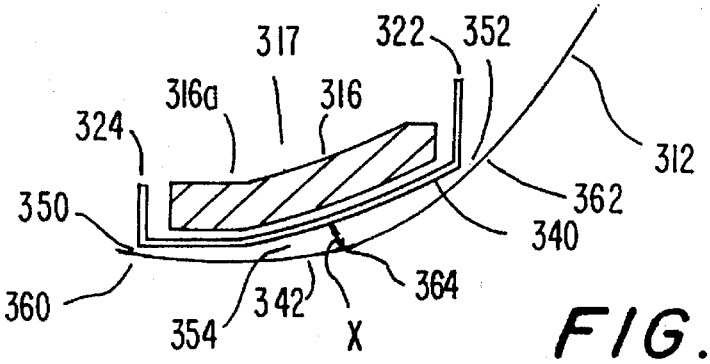
FIG. 11 is an enlarged partial view of a portion of the apparatus of FIG. 9 to which reference will be made in explaining the spacing between the deflection yoke and a tube device of such apparatus.
Figure 12A:
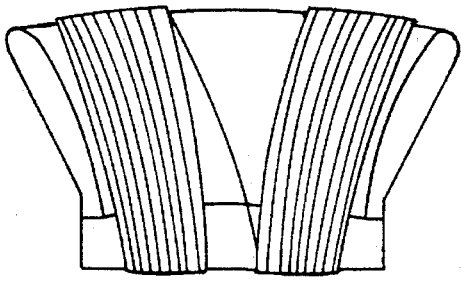
FIGS. 12A, 12B, 12C and 12D are schematic diagrams illustrating respective ones of biased and unbiased coils.
Figure 12B:
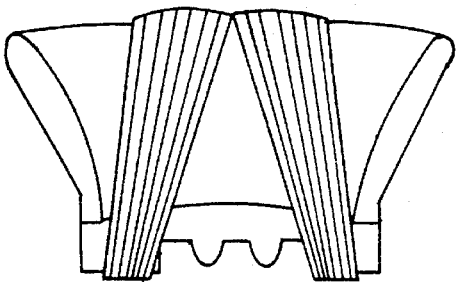
Figure 12C:
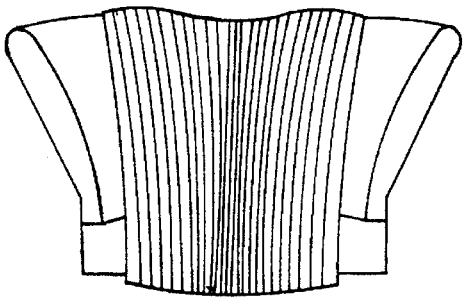
Figure 12D:
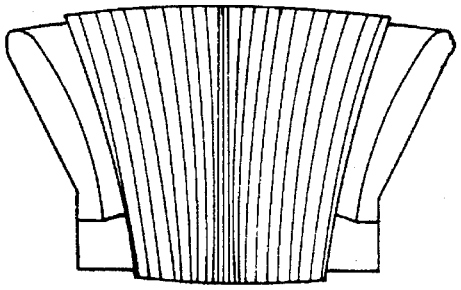

An enlarged view illustrating the above-described relationship between the inner surface 340 of the DY 316 and the outer surface 342 of the envelope 312 is shown in FIG. 11. The gap 354 may have a value X as shown in FIG. 11 greater than or equal to approximately 4 millimeters than the values of either of the gaps 350 and 352.

Therefore, unlike the deflection yokes 16 and 216 of FIGS. 1 and 7, respectively, the inner surface 340 of the DY 316 has a contour such that the middle gap 354 is substantially larger than either of the front and rear gaps 352 and 350, respectively. Further, the mold core 335 and the cross-arm 330 of the DY 316 are relatively close to the corresponding portions of the envelope 312 due to the gaps 350 and 352. As a result, the effects associated with the cross-arm 330 and the mold core device 335, that is, the pin-cushion shaped field at the front of the DY and the compensating over-barreling at the rear of the DY, respectively, are enhanced or relatively strong and may be stronger than those of other CRT apparatuses such as the CRT apparatuses 10 and 200 of FIGS. 1 and 7, respectively. Furthermore, since a relatively large distance exists between the main deflecting portion of the DY 316 and the envelope 312, an over-all balance between the two types of fields, that is, the pin-cushion shape and the barrel shape, may be obtained. Such balancing corrects both EW pin-cushion distortion and other misconvergence errors.

Therefore, by utilizing a deflection yoke, such as DY 316, having an inner surface with a predetermined contour so as to provide a middle gap 354 which is substantially larger than either of the front and rear gaps 352 and 350, respectively, as previously described, enables a magnetic field to be produced by the DY 316 which deflects the electron beams in a predetermined manner so as to provide a video image on the screen 318, which may have a substantially cylindrical shape and a relatively flat surface, which is either free of EW pin-cushion shaped distortion of the geometric raster and other geometric and misconvergence distortions or with a minimum or relatively low amount of such distortion.

Although the panel of the above-described CRT apparatus 300 was described as having a cylindrical shape and a relatively flat surface, the present invention is not so limited and may be applied to panels having other shapes such as spherical and so forth.

Further, although the DY 316 of the CRT apparatus 300 utilizes the cross-arm 330 and the mold-core device 335 to respectively obtain the pin-cushion shaped and the barrel shaped field as previously described, the present invention is not so limited and other means may be utilized to create such fields. For example, a biased winding technique of the vertical coil of the deflection yoke, similar to that previously described with reference to FIG. 12, in which the angular position of the wires in the coil winding vary from front to back of the deflection yoke, may be used.

Furthermore, although in the above-described CRT apparatus 300 the DY 316 was configured such that a single gap 354 exists between the middle portion 317 thereof and the envelope 312, the present invention is not so limited. Alternatively, the DY 316 may be configured such that more than one relatively large middle gap exists. For example, as shown in FIG. 13, the middle portion of an inner surface 340' of a DY 316' may have a scalloped-like configuration so as to have a plurality of relatively large middle gaps 500 with respective adjacent members 502 therebetween. The members 502 have relatively small gaps between itself and the corresponding portion of the outer surface of the envelope 312.

Still further, although in describing the CRT apparatus 300, the DY 316 was configured so as to produce the gaps 350, 352 and 354 or 500, the present invention is not so limited. Alternatively, the outer surface 342 of the envelope 312 may be modified or configured so as to produce the gaps 350, 352 and 354 or 500. As a further alternative, both the DY 316 and the envelope 312 may both be modified or configured so as to contribute to the formation of such gaps.

Although a preferred embodiment of the present invention and modifications thereof have been described in detail herein, it is to be understood that this invention is not limited to this precise embodiment and modifications, and that other modifications and variations may be affected therein by one skilled in the art without departing from the scope and spirit of the invention as defined by the appended claims.

What is claimed is:

1. An apparatus for displaying video images, said apparatus comprising:

cathode ray tube means including a screen for producing a plurality of electron beams each corresponding to a respective color and, in response to a magnetic field, for converging said electron beams onto said screen so as to cause video images corresponding to the converged electron beams to be displayed thereon; and deflection yoke means for producing said magnetic field, said deflection yoke means being arranged such that an inner surface thereof is adjacent to an outer surface of said cathode ray tube means, in which at least one of said inner surface and said outer surface has a predetermined contour such that each respective end distance between the inner surface of both end portions of said deflection yoke means and respective adjacent parts of said outer surface of said cathode ray tube means is relatively small and such that a middle distance between said outer surface of said cathode ray tube means and the inner surface of a middle portion of said deflection yoke means is substantially larger than each of the end distances, said end and middle distances cause said magnetic field to be enhanced and balanced so as to compensate for undesired pin-cushion distortion and misconvergence errors.

2. An apparatus according to claim 1, wherein said magnetic field has a plurality of field lines associated therewith and wherein said deflection yoke means includes first shaping means for shaping said field lines of said magnetic field so as to have a barrel shape.

3. An apparatus according to claim 2, wherein said first shaping means is arranged at a rear portion of said deflection yoke means.

4. An apparatus according to claim 3, wherein at least a portion of said first shaping means is fabricated from a magnetic material having a relatively high permeability.

5. An apparatus according to claim 3, wherein said deflection yoke means further includes second shaping means for shaping the barrel shaped field lines of said magnetic field so as to have a pin-cushion shape.

6. An apparatus according to claim 5, wherein said second shaping means is arranged at a front portion of said deflection yoke means.

7. An apparatus according to claim 6, wherein at least a portion of said second shaping means is fabricated from cold rolled silicon-type steel.

8. An apparatus according to claim 6, wherein said inner surfaces of the end portions contact the respective adjacent parts of said outer surface of said cathode ray tube means so that the end distances of are effectively zero.

9. A deflection yoke apparatus for use with a cathode ray tube, said deflection yoke being arranged such that an inner surface thereof is adjacent to an outer surface of said cathode ray tube, said deflection yoke apparatus comprising:

a rear portion having means for producing a magnetic field having a plurality of barrel shaped field lines associated therewith;

a front portion having means for producing a magnetic field having a plurality of pin-cushion shaped field lines associated therewith; and a middle portion located between said front and rear portions;

said inner surface having a predetermined contour such that each respective end distance between the inner surface of said rear and front portions and respective adjacent parts of said outer surface of said cathode ray tube is relatively small and such that a middle distance between said inner surface of said middle portion and an adjacent part of said outer surface of said cathode ray tube is substantially larger than each of the end distances, said end and middle distances cause said magnetic fields to be enhanced and balanced so as to compensate for undesired pin-cushion distortion and misconvergence errors.

10. An apparatus according to claim 9, wherein at least a part of said means for producing said magnetic field having said pin-cushion shaped field lines is fabricated from cold rolled silicon-type steel.

11. An apparatus according to claim 10, wherein at least a part of said means for producing said magnetic field having said barrel shaped field lines is fabricated from a magnetic material having a relatively high permeability.

12. An apparatus according to claim 9, wherein said inner surfaces of said front and rear portions contact said respective adjacent parts of said outer surface of said cathode ray tube so that the end distances are effectively zero.

13. An apparatus for displaying video images with a minimum or relatively low amount of so-called east/west pin-cushion distortion, said apparatus comprising:

cathode ray tube means including a screen for producing a plurality of electron beams and, in response to a magnetic field having field lines arranged in a predetermined manner, for converging said electron beams onto said screen so as to cause video images corresponding to the converged electron beams to be displayed thereon with a minimal or relatively low amount of said east/west pin-cushion distortion; and deflection yoke means arranged such that an inner surface thereof is adjacent to an outer surface of said cathode ray tube means for producing said magnetic field, said deflection yoke means having a middle portion and two end portions and being coupled to said cathode ray tube means such that each respective end distance between the inner surfaces of said two end portions and respective adjacent parts of the outer surface of said cathode ray tube means is relatively small and such that a middle distance between the inner surface of said middle portion and an adjacent part of the outer surface of said cathode ray tube means is substantially larger than each of the respective end distances, said end and middle distances cause said magnetic field to be enhanced and balanced so as to compensate for said east/west pin-cushion distortion.

14. An apparatus according to claim 13, wherein a rear one of said end portions of said deflection yoke means includes means for producing said magnetic field having barrel shaped field lines and wherein a front one of said end portions of said deflection yoke means includes reshaping means for reshaping said magnetic field so as to have pin-cushion shaped field lines.

15. An apparatus according to claim 14, wherein at least a portion of said means for producing is fabricated from a magnetic material having a relatively high permeability.

16. An apparatus according to claim 14, wherein at least a portion of said reshaping means is fabricated from cold rolled silicon-type steel.

17. An apparatus according to claim 14, wherein said inner surfaces of the front and rear end portions contact said outer surface of said cathode ray tube means so that the end distances are effectively zero.

18. An apparatus according to claim 9, wherein said end distances cause the barrel shaped and pin-cushion shaped magnetic fields to be enhanced and said middle distance cause a desired balancing between said barrel shaped and pin-cushion shaped magnetic fields.

19. An apparatus for displaying video images, said apparatus comprising:

cathode ray tube means including a screen for producing a plurality of electron beams each corresponding to a respective color and, in response to a magnetic field having a plurality of field lines, for converging said electron beams onto said screen so as to cause video images corresponding to the converged electron beams to be displayed thereon; and deflection yoke means for producing said magnetic field, said deflection yoke means including only one deflecting portion having first shaping means arranged at a rear portion of said deflection yoke means for shaping said field lines of said magnetic field so as to have a barrel shape and second shaping means arranged at a front portion of said deflection yoke means for shaping said field lines of said magnetic field so as to have a pin-cushion shape, said deflection yoke means being arranged such that an inner surface thereof is adjacent to an outer surface of said cathode ray tube means, said inner surface and said outer surface having predetermined respective contours such that each respective end distance between the inner surface of said rear and front portions and respective adjacent parts of said outer surface of said cathode ray tube means is relatively small and such that a middle distance between said outer surface of said cathode ray tube means and the inner surface of a middle portion of said deflection yoke means is substantially larger than each of the end distances, said end and middle distances cause said magnetic field to be enhanced and balanced so as to correct for undesired pin-cushion distortion and misconvergence errors.

* * * * *